US005791811A

United States Patent [19]

Yoshino

[11] Patent Number: 5,791,811

[45] Date of Patent: Aug. 11, 1998

[54] SHOCK ABSORBING WALL CONSTRUCTION

[76] Inventor: Koichi Yoshino, 9-2, Izumidai 3-chome, Kita-ku, Kobe-shi, Hyogo 651-11, Japan

[21] Appl. No.: 699,777

[22] Filed: Aug. 13, 1996

[51] Int. Cl.[6] ..... E01F 15/02

[52] U.S. Cl. ..... 404/6; 256/13.1; 404/7; 267/139

[58] Field of Search ..... 404/6, 7, 8, 10; 256/1, 13.1; 267/139, 140, 140.11, 153; 293/120.122, 110, 136

[56] References Cited

U.S. PATENT DOCUMENTS

| | | | |
|---|---|---|---|
| 3,179,397 | 4/1965 | Cleerman et al. | 267/140 |
| 3,473,836 | 10/1969 | Halter | 267/140 X |
| 4,186,915 | 2/1980 | Zeller et al. | 267/140 |
| 4,307,973 | 12/1981 | Glaesener | 404/6 |
| 4,358,090 | 11/1982 | Glaesener | 256/1 |
| 4,435,106 | 3/1984 | Forster et al. | 256/13.1 X |
| 4,548,150 | 10/1985 | Drewett | 267/140 X |
| 4,613,177 | 9/1986 | Loren et al. | 293/136 X |
| 4,786,100 | 11/1988 | Kleemann et al. | 267/153 X |
| 5,336,016 | 8/1994 | Baatz | 256/13.1 X |

FOREIGN PATENT DOCUMENTS 5-272120 10/1993 Japan .

*Primary Examiner*—James Lisehora
*Attorney, Agent, or Firm*—Jordan and Hamburg

[57] ABSTRACT

A shock absorbing wall construction makes it possible to prevent the car from rolling over and protect the car occupant's head and neck in case of car crashes. The shock absorbing wall construction has a main shock absorber part or portion having an elastic and solid body and sub-shock absorber part or portion which is mounted on the upper front surface of the main shock absorber part. The lower front surface of the main shock absorber part curves concavely upward and forwardly outward from a lower end to its center to prevent the car from rolling over. The sub-shock absorber part projects forwardly along the length of the lower front surface and includes one or more air rooms or chambers inside it and piercing air vent holes which extend through the air chamber sidewalls so as to protect the passenger's head and neck.

27 Claims, 10 Drawing Sheets

SHOCK ABSORBING WALL CONSTRUCTION

FIELD OF THE INVENTION

The present invention relates to a shock absorbing wall construction which absorbs and softens the impact forces of car crashes. In particular, the present invention relates to a shock absorbing wall construction which is effective for use as a wall along a circuit race course or as a guardrail installed at a road corner.

BACKGROUND OF THE INVENTION

It takes about 2/10 seconds for a driver to take evasive action on first becoming aware of a suspected road danger. As such, when a vehicle is travelling at a speed of 100 kilometers an hour, the car will travel as far as about 20 meters toward the danger from the time the driver first suspects the danger to the time evasive action is taken. The faster the car travels, the further the car will travel. In addition, if there is a time-lag prior to first becoming aware of the danger, the distance travelled by the vehicle prior to evasive action may be much greater. A racing car may travel along race course straight-aways at speeds beyond 300 kilometers an hour in car races such as Formula 1, with the result that a momentary incorrect judgment may result in a serious accident.

A car body is primarily designed for absorbing head-on impact crash energy to ensure the driver's safety in the event of a crash. Although the sides of vehicles have recently been strengthened by the use of side beams and the like, typical vehicle doors are made of sheet metal and do not sufficiently absorb side-impact crash energy to adequately protect the driver. It is believed that Formula-1 race car bodies similarly fail to provide adequate protection for side-impact crashes.

For example, when a car crashes into a wall or guardrail by travelling off course or spinning out of control, the portion of the car which first contacts the wall is damaged (first crash) on the one hand, and the non-impacted side comes up and the car turns sideways on the other hand, with the result that there is the danger of causing a second accident. At this time, unless the driver is firmly secured by a seat belt, he will be thrown from or within the inside of the car and may be injured (second crash). This is the most general injury mechanism.

In a side-impact car accident, a driver is unable to do anything to avoid side-impact forces. If a man wearing a seat belt experiences side-impact forces, the impact forces work directly through his body, resulting in injuries to his neck, side stretching and soft tissue damage, bone fractures and ligament damage. In many cases, excess side stretching may damage the cervical spine, and cause fracture of a bone or ligament damage. Ligament damage causes central lower nervous system injury, partial paralysis or even quadriplegia, as well as central upper nervous system injury and may result in fatal breathing paralysis. In addition, in side-impact crashes a driver may injure his head causing brain blood vessel injury or the impact may cause internal hemorrhaging of the thorax and abdomen.

In Japanese Non-examined Patent Publication No. 5-272120, and shown in FIG. 11, there is disclosed structure for use on the surface of a wall 3 to prevent damage in the event of accidents. The structure consists of a ball-shaped buffer 2 which includes two elastic and hard-crashed ring-shaped bodies formed of a tire material which cross each other, and which are mounted to the surface of the wall 3.

A disadvantage with the known impact buffering structure exists in that the ring-shaped bodies cannot effectively absorb the crash energy of high impact forces. In addition, known impact buffering structures fail to give consideration to preventing the car from rolling sideways. Furthermore, it is very time consuming and labour intensive to mount a sufficient number of ball-shaped buffers to the surface of the wall to provide adequate impact protection.

SUMMARY OF THE INVENTION

It is an object of the present invention to provide a shock absorbing wall construction which effectively contains and absorbs crash energy from car crashes.

It is another object of the present invention to provide a wall construction which prevents the non-impact side of a vehicle from rising up and rolling sideways in a car crash.

It is another object of the present invention to provide a shock absorbing wall construction which may be mounted in place quickly and easily.

The above objects are effected by a shock absorbing wall construction having a main shock absorber part or portion having an elastic and solid body and sub-shock absorber part or portion which is mounted on the upper front surface of the main shock absorber part. The lower front surface of the main shock absorber part curves concavely upward and forwardly outward from a lower end to its center. The sub-shock absorber part projects forwardly along the length of the lower front surface and includes one or more air rooms or chambers inside it and piercing air vent holes which extend through the air chamber sidewalls.

DETAILED DESCRIPTION OF THE PREFERRED EMBODIMENT

The preferred embodiment of the present invention will be described referring to drawings.

Figure 1A:
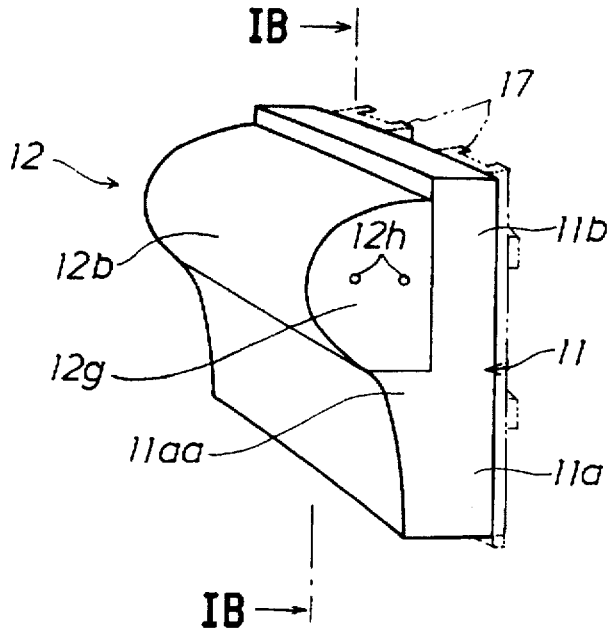
FIG. 1A is a perspective illustration of the shock absorbing wall construction in accordance with a first embodiment of the present invention.
Figure 1B:
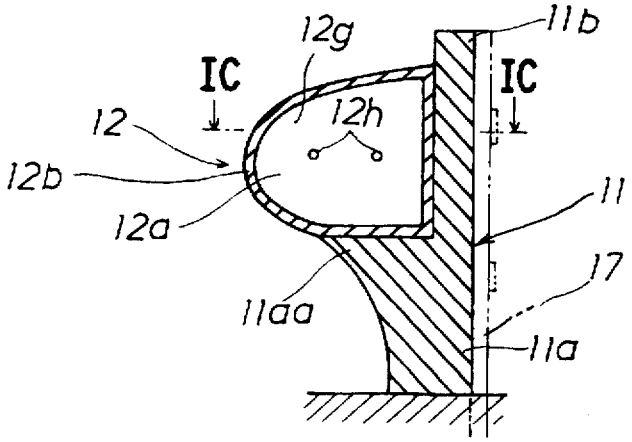
FIG. 1B is a sectional view taken substantially along the lines A—A of FIG. 1A.
Figure 1C:
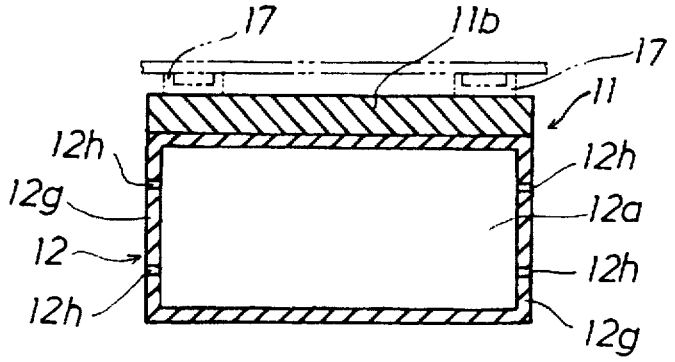
FIG. 1C is a sectional view taken substantially along the lines B—B of FIG. 1B.

FIG. 1 shows best a shock absorbing wall construction which includes a main shock absorber part 11 which is made of a single elastic solid body, such as hard rubber, and a sub-shock absorber part 12. The front outer surface of the lower half 11*a* of the main shock absorber part 11 curves concavely upwardly and forwardly outward from a lower bottom end to an outermost portion 11*aa* at the center of the part 11. The upper half 11*b* of part 11 connects to the sub-shock absorber part 12, and defines a mounting surface to which the sub-shock absorber part 12 is secured.

The sub-shock absorber part 12 is made of elastic body, such as hard rubber, and preferably is the same material as the main shock absorber part 11. Mounted on the upper half 11*b* of a main shock absorber part, the sub-shock absorber part 12 projects forwardly beyond the outermost front portion 11*aa* of the lower half 11*a*. The sub-shock absorber part 12 includes an internal air chamber 12*a* having two air vent holes 12*h* piercing both side walls 12*g* of the sub-shock absorber part 12. The air chamber 12*a* acts as a cushion to absorb impact forces and on impact will collapse to expel approximately 15 to 30% of the air volume therein, outwardly via air vent holes 12*h*. It is to be appreciated, however, that the air volume to be expelled on impact may vary having regard to the site of installation, the type and anticipated speed of vehicle to be protected and the overall shape of the sub-shock absorber part.

If the piercing air vent holes 12*h* are formed too wide, the air inside the air chamber 12*a* will escape too quickly in the event of a crash impact, so that the sub-shock absorber part 12 will not sufficiently absorb the crash energy. As such, the piercing air vent holes are formed having a size selected to let air out of the chamber 12*a* gradually in the event of a crash impact.

Referring now to embodiment shown in FIG. 1, the main shock absorber part 11 and the sub-shock absorber part 12 are coupled to each other by an adhesive agent. To achieve the best possible coupling, it is preferable that the main shock absorber part be made from the same material as that of the sub-shock absorber part 12, to maintain joint strength. The shock absorbing wall construction of the present invention is supported on a support 17 extending along the back of the main shock absorber part 11.

Figure 2:
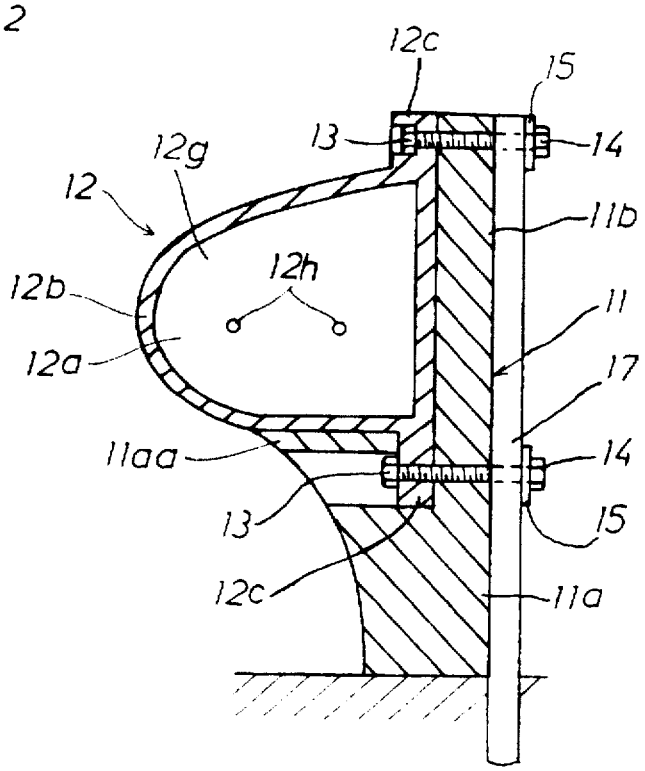
FIG. 2 is a longitudinal sectional view of a shock absorbing wall construction in accordance with a second embodiment of the present invention.

Referring now to FIG. 2, the main shock absorber part 11 and the sub-shock absorber part 12 are coupled by bolts 13 which are fastened with nuts 14 and which extend through bores formed in the upper and lower portions of the wall construction, instead of an adhesive agent. In this case, it is not necessary that the material used to form the main shock absorber part 11 be the same as that of the sub-shock absorber part 12. By the use of bolts 13 and nuts 14 to couple the parts 11 and 12, it is possible to easily replace a damaged main shock absorber part 11 or sub-shock absorber part 12 by another new one in the event the shock absorbing wall construction is damaged. A flange 12*c* is provided on upper and lower back sides of the sub-shock absorber part 12 for attachment to the main shock part 11. In this case, it is important to secure the bolts 13 and nuts 14 so as not to project out the front surface of construction. In the embodiment shown, a reinforcing plate is further provided to enable more secure coupling to the supports 17.

Figure 3A:
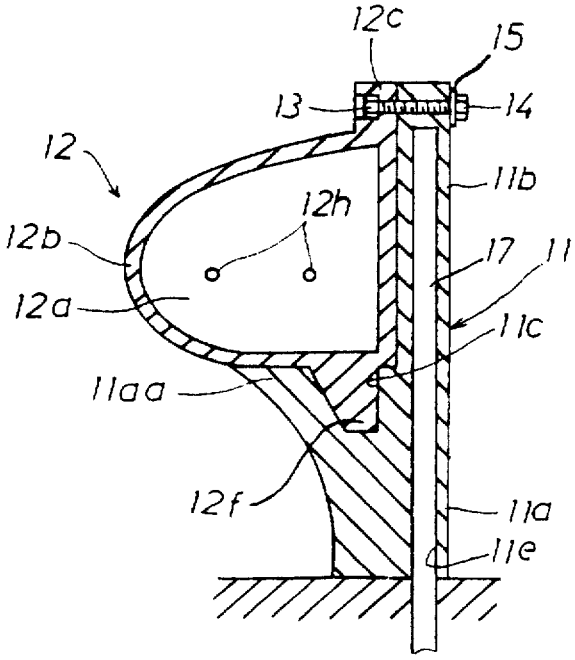
FIG. 3A is a longitudinal sectional view of a shock absorbing wall construction in accordance with a third embodiment of the present invention.

Referring now to FIG. 3A, the main shock absorber part 11 is shown as being coupled to the sub-shock absorber part by the engagement of a downwardly extending boss 12*f* provided on the part 12, within a complementary shaped groove 11*c* formed in the contact surface of the main shock absorber, in place of the lower flange 12*c*, lower bolt 13 and lower nut 14 shown in FIG. 2.

Referring now to the embodiment shown in FIG. 3A, a guide hole 11*e* sized to receive the support 17 therein is formed in the main shock absorber part 11. The use of the guide hole 11*e* advantageously permits simplified replacement of damaged main shock absorber parts 11, or sub-shock absorber parts 12 by new ones.

Figure 3B:
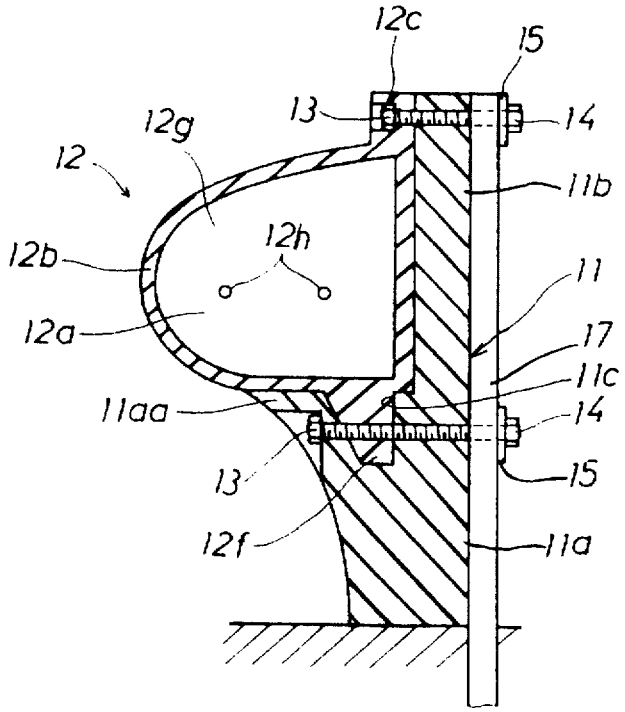
FIG. 3B is a longitudinal sectional view of a shock absorbing wall construction in accordance with a fourth embodiment of the present invention.

Referring to FIG. 3B, the main shock absorber part 11 and the sub-shock absorber part 12 are coupled to a support 17 arranged along the back side of part 11, by bolts 13 and nuts 14. In the embodiment shown, the lower bolt 13 is inserted through a bore which extends across the groove 11*c* and through the boss 12*f* to more tighten and securely fasten the parts 11 and 12.

Figure 4:
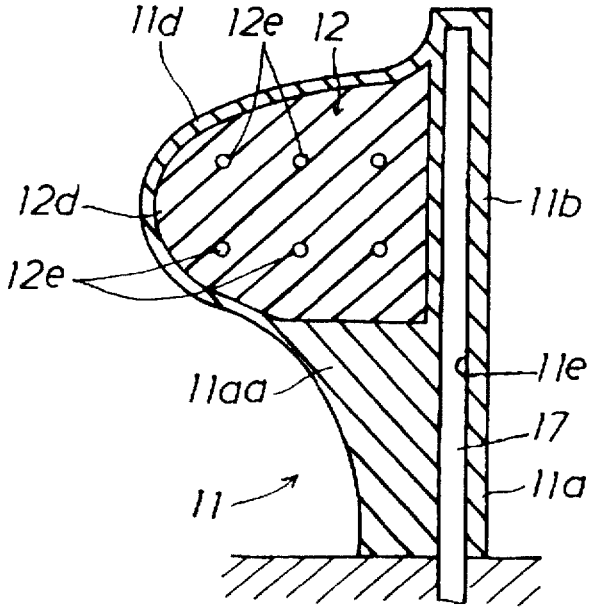
FIG. 4 is a longitudinal sectional view of a shock absorbing wall construction in accordance with a fifth embodiment of the present invention.

Referring now to FIG. 4, the sub-shock absorber part 12 fits into a supporting cavity or enclosed portion 11*d* in the upper half 11*b* of the main shock absorber part 11. A number of elongated air chambers 12*a* are provided in the sub-shock absorber part 12 in a parallel arrangement and which are separated by walls 12*d* having a thickness of several centimeters. Piercing air vent holes 12*e* are formed in the separating walls 12*d* to enable flow air into adjacent air chambers 12*a*.

Figure 5A:
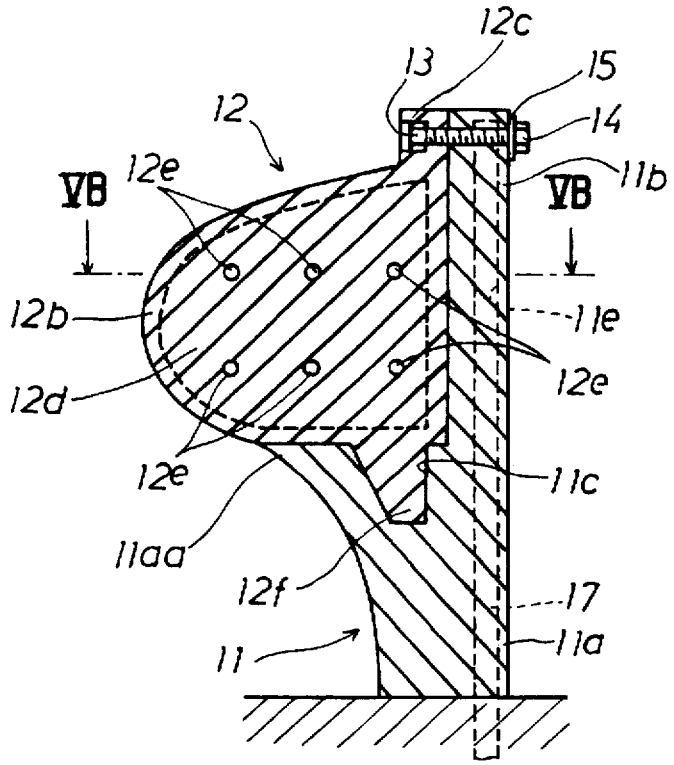
FIG. 5A is a longitudinal sectional view of a shock absorbing wall construction in accordance with a sixth embodiment of the present invention.
Figure 5B:
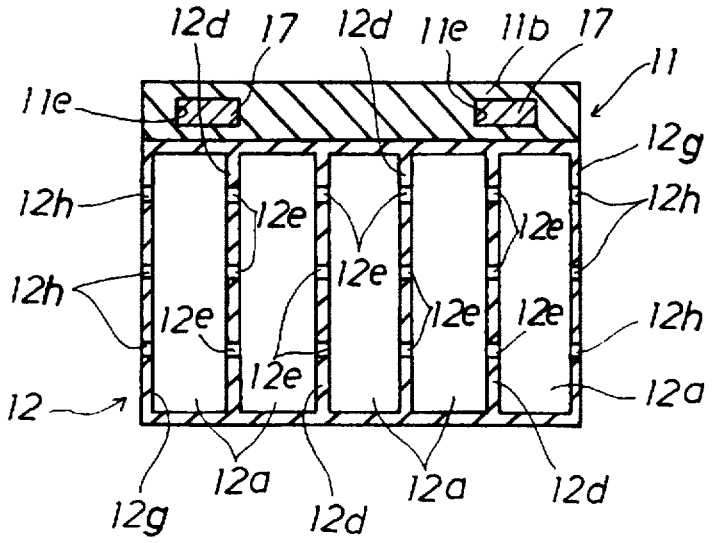
FIG. 5B is a sectional view taken substantially along the lines A—A of FIG. 5A.

FIG. 5A and FIG. 5B show a wall construction which includes a plurality of air chambers 12*a* in the sub-shock absorbing part 12 shown in FIG. 3 arranged in parallel, in the same manner as the embodiment shown in FIG. 4. A piercing hole 12*e* is also set in the walls 12*d* separating each air chamber 12*a*.

Figure 7:
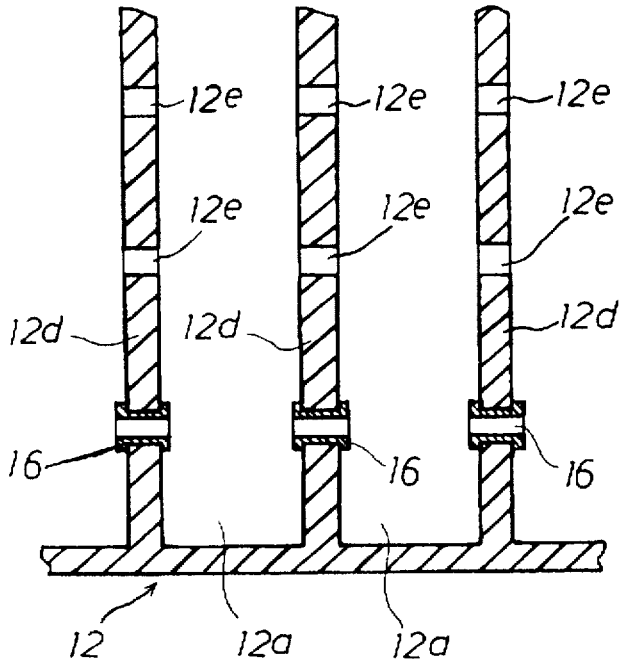
FIG. 7 is a main transverse sectional view of sub-shock absorption part illustrating a bush set on the piercing air vent hole surface side of the sub-shock absorber part.

In the embodiment shown, if the sub-shock absorbing part 12 is made of a hard polyurethane form, it is preferable that a cylindrical metal bushing 16 be fitted into the piercing holes 12*e* set in the separating walls 12*d*. More preferably, the metal bushings 16 are positioned near the front of the construction, as shown in FIG. 7, to prevent lacerations caused by wind and rain.

Figure 6:
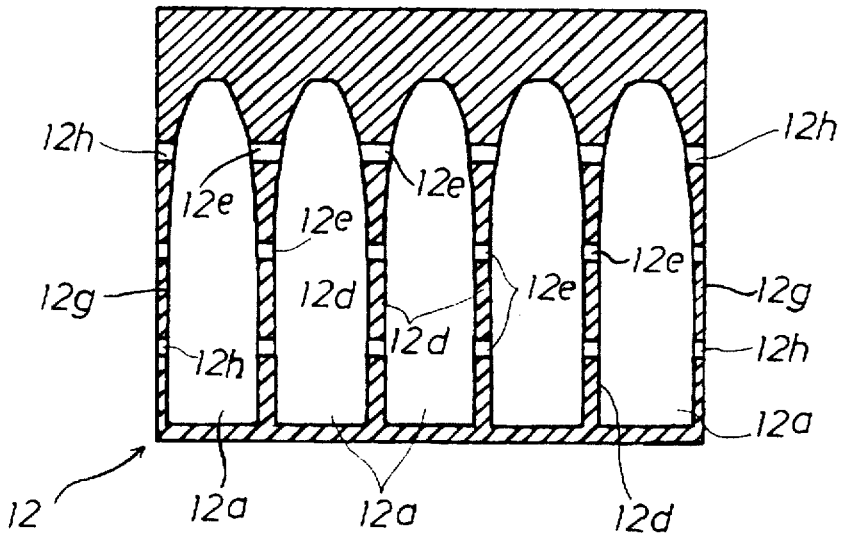
FIG. 6 is a transverse sectional view of sub-shock absorption part consisting of the shock absorbing wall construction in accordance with a seventh embodiment of the present invention.

FIG. 6 shows best the wall 12*d* separating the air chambers 12*a* of the sub-shock absorber part 12 (as shown in FIG. 5A and FIG. 5B) as getting thicker toward back side of the sub-shock absorber part 12. The thickening walls 12*d* advantageously enable the part 12 to absorb right angle impact forces.

Figure 8A:
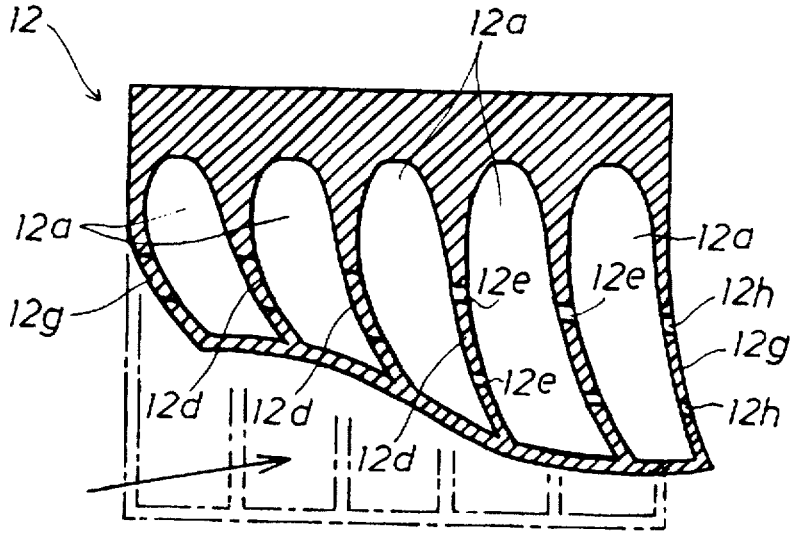
FIG. 8A illustrates the deformation of the sub-shock absorber part when impacted with an oblique crash force shown in FIG. 9.
Figure 8B:
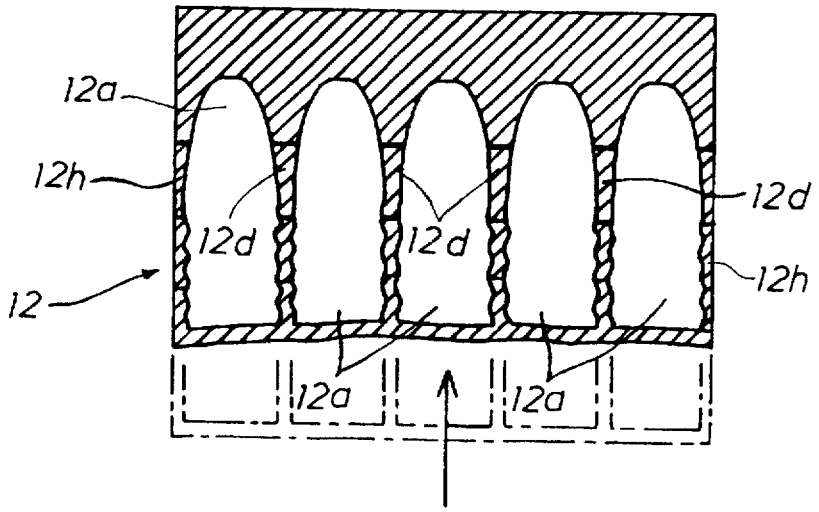
FIG. 8B illustrates the deformation of the sub-shock absorber part when impacted with a right angle crash force shown in FIG. 9.

FIG. 8A illustrates how the sub-shock absorption part 12 shown in FIG. 6 bends with an oblique shock or impact forces. FIG. 8B illustrates how the sub-shock absorption part 12 shown in FIG. 6 bends with a right angle shock or impact forces.

Referring now to FIG. 8A, the air inside air chambers 12*a* will flow outwardly through the piercing holes 12*e* with an oblique shock. As a result of the oblique forces, the part 12 changes its shape since sub-shock absorption part 12 is formed as an elastically deformable body.

Referring now to FIG. 8B, it is also possible to absorb right angle impact forces since the separating walls 12*d* thicken toward the back surface of the part 12. On right angle impacts the piercing air vent holes 12*e* and 12*h* are closed as a result of the collapse of the part 12 so that the air inside the air chambers 12*a* becomes a cushion against the impact forces.

Figure 9:
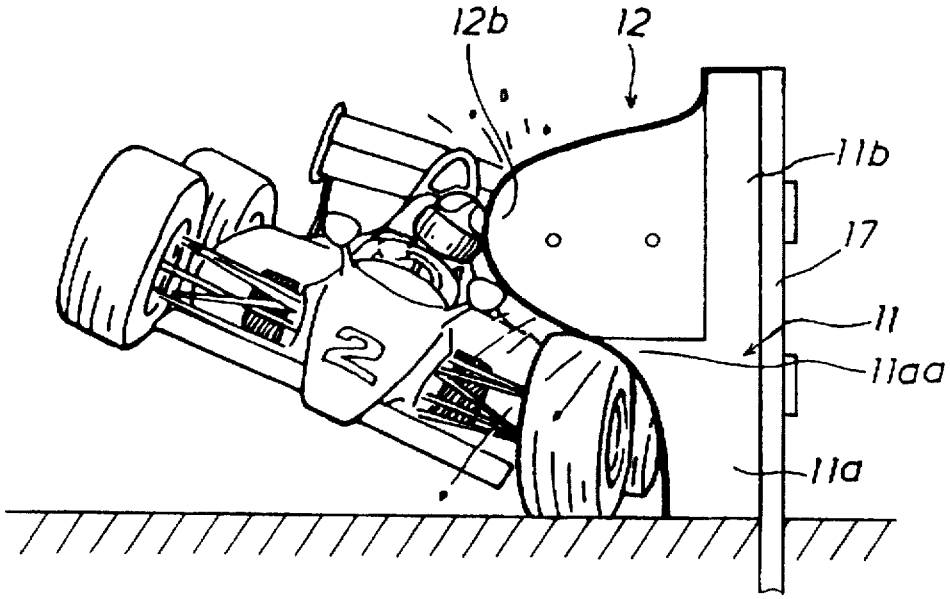
FIG. 9 illustrates a state of a car's crashing into the shock absorbing wall construction of the present invention.

Referring now to FIGS. 1–6, a projecting part 12*b* of the sub-shock absorbing part 12 is set at the same position as a driver's head in the event his car crashes into the front surface of the circuit wall shown in FIG. 9. If a racing car comes close to the shock absorbing wall construction of the present invention, the car wheels on the wall side of the vehicle move into the concave portion of lower half 11*a*, so as to keep the car in the driving position and prevent the car from flipping over. Furthermore, even if the car body is to come up with the force of inertia, the projecting portion 12*b* of the sub-shock absorbing part 12 prevents the car from rolling over. The projecting portion 12*b* also absorbs the shock of the crash on the driver's head.

Figure 10:
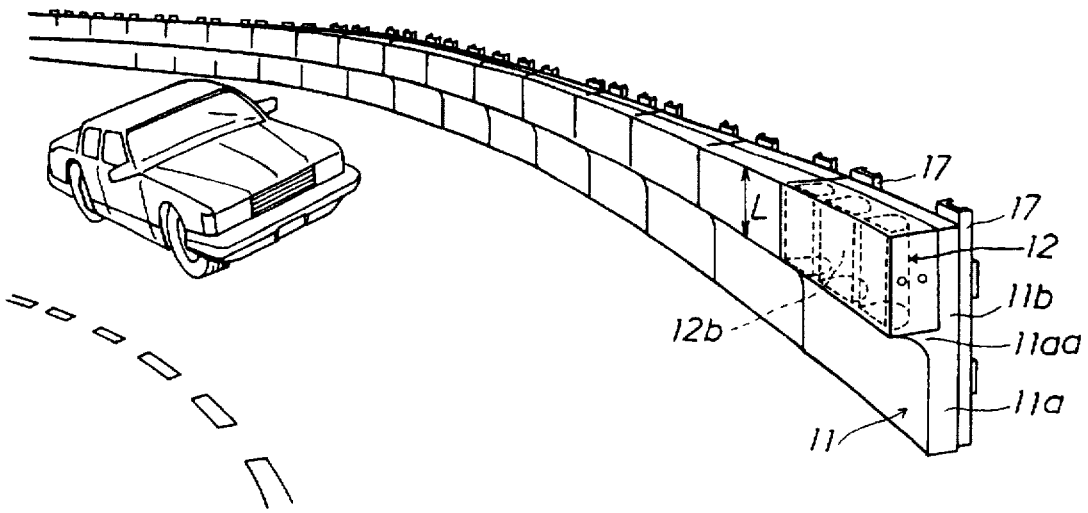
FIG. 10 illustrates a state of the shock absorbing wall construction in accordance with the present invention, in which rectangular sub-shock absorber parts set on the road corner.
Figure 11:
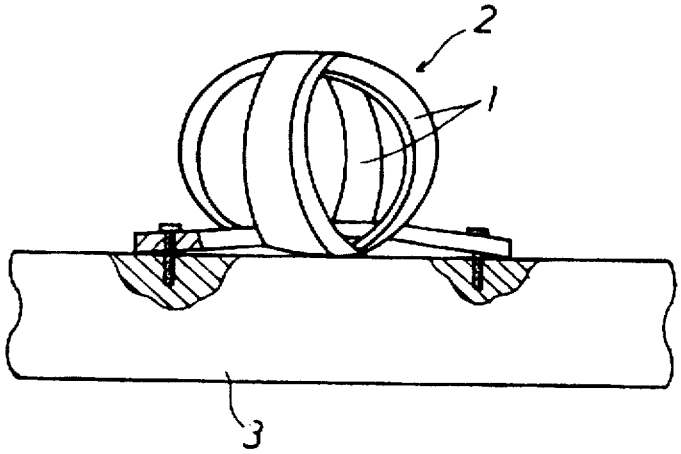
FIG. 11 PRIOR ART
FIG. 11 is a partially cut away front view of prior art shock absorbing structure for mounting on a wall surface.

In an alternate use, the shock absorbing wall construction is provided as a rectangular shape, set on the guardrail shown in FIG. 10. In this case, it is also better that the length L of the projecting portion 12*b* of the sub-shock absorbing part 12 is designed to absorb shock effectively wherever a driver's and passenger's head is positioned in proportion to the height of the car body. In this configuration, it is possible to effectively absorb impact forces on a driver's and passenger's breast and abdomen.

It is possible to use every kind of raw rubber, vulcanized rubber, mixed rubber, rubber mixed material like rubber, particle and fiber, reinforcing particle rubber with carbon black as high reinforcing particle, reinforcing short fiber rubber, reinforcing long fiber rubber, cellular rubber and latex to form the main shock absorbing part 11 and/or the sub-shock absorbing part 12. It is also possible to use new materials, such as ultra elastic functional materials for increased endurance and elasticity.

The above explanations relate to a shock absorbing wall to be set on the guardrail or as part of a race circuit wall. The shock absorption structure of the present invention is, however, applicable to any of a number of places.

As the above explanations, the lower front of the shock absorption structure of the present invention curves upwardly and outwardly from lower end to the center of the part 11 so that it makes it possible to maintain driving position by the driver's wheel fitting under the projecting portion of the construction. Even if the car body is to come up with the force of inertia, the projecting portion of the sub-shock absorber part 12 prevents the car from turning sideways. Moreover, the sub-shock absorber part 12 absorbs and softens the shock of a crash into the surface of wall caught by passenger's head when the car body comes up. In this manner, the shock absorbing wall construction advantageously prevents serious damage to the car occupant's cervical vertebrae and abdomen.

Although the detailed description describes and illustrates preferred embodiments of the present apparatus, the invention is not so limited. Modifications and variations will now appear to persons skilled in this art. For a definition of the invention reference may be had to the appended claims.

I claim:

1. A shock absorbing wall comprising:

a main shock absorber member formed of an elastic material, said main shock absorber member having a supporting portion at an upper portion thereof and a bottom forward edge;

a sub-shock absorber member mounted on said supporting portion of said main shock absorber member;

said main shock absorber member having a front surface, the front surface having a center area, a lower front surface, and a most forward portion at said center area, said lower front surface concavely extending from said bottom forward edge of said main shock absorber member to said center area of said front surface; and the sub-shock absorber member projecting forward of the bottom forward edge of the main shock absorber member at least as far as said most forward portion of said front surface of the main shock absorber member and having an air chamber with air vent holes communicating with the air chamber to vent air out of said main shock absorber member, said vent holes being dimensioned so as to permit air to escape gradually during a crash impact.

2. The shock absorbing wall as defined in claim 1 wherein said main shock absorber member and said sub-shock absorber member are connected with threaded fastening means.

3. The shock absorbing wall as defined in claim 2 wherein said sub-shock absorber member has at least two air chambers, including said air chamber, within the sub-shock absorber member, and a partition separating said at least two air chambers and having a plurality of air vent holes provided in said partition interconnecting the at least two air chambers.

4. The shock absorbing wall as defined in claim 3 further comprising a cylindrical bushing fitted into at least one vent hole of said air vent holes and said plurality of air vent holes, said at least one air vent hole being disposed near the front surface of the sub-shock absorber member, so as to maintain said at least one vent hole in an open state during said crash impact.

5. The shock absorbing wall as defined in claim 4 wherein a thickness of the partitions inside said sub-shock absorber member increases towards a back side of the sub-shock absorber member.

6. The shock absorbing wall as defined in claim 2 wherein a concavity is provided in said supporting portion of the main shock absorber member and a projecting portion provided on the sub-shock absorber member sized to fit into the concavity of said main shock absorber member.

7. The shock absorbing wall as defined in claim 6 wherein said sub-shock absorber member has at least two air chambers, including said air chamber, within the sub-shock absorber member, and a partition separating said at least two air chambers and having a plurality of air vent holes provided in said partition interconnecting the at least two air chambers.

8. The shock absorbing wall as defined in claim 7 further comprising a cylindrical bushing fitted into at least one vent hole of said air vent holes and said plurality of air vent holes, said at least one air vent hole being located near the front surface of the sub-shock absorber member, so as to maintain said at least one vent hole in an open state during said crash impact.

9. The shock absorbing wall as defined in claim 8 wherein a thickness of the partition inside said sub-shock absorber member increases towards a back side of the sub-shock absorber member.

10. The shock absorbing wall as defined in claim 1 wherein said sub-shock absorber member has at least two air chambers, including said air chamber, within the sub-shock absorber member, and a partition separating said at least two air chambers and having a plurality of air vent holes provided in said partition interconnecting the at least two air chambers.

11. The shock absorbing wall as defined in claim 10 further comprising a cylindrical bushing fitted into at least one vent hole of said air vent holes and said plurality of air vent holes, said at least one air vent hole being disposed near the front surface of the sub-shock absorber member, so as to maintain said at least one vent hole in an open state during said crash impact.

12. The shock absorbing wall as defined in claim 11 wherein a thickness of the partition inside said sub-shock absorber member increases towards a back side of the sub-shock absorber member.

13. The shock absorbing wall according to claim 1 wherein said sub-shock absorber member projects forward of said most forward portion of said front surface of the main shock absorbing member.

14. A shock absorbing wall comprising:

a main shock absorber member formed of an elastic material, said main shock absorbing member having a supporting portion at an upper portion thereof and a bottom forward edge;

a sub-shock absorber member mounted on said supporting portion of said main shock absorber member;

said main shock absorber member having a front surface with a center area, a lower front surface concavely extending from said bottom forward edge of said main shock absorber member to said center area of said front surface, and a most forward portion at said center area;

the sub-shock absorber member projecting forward of the bottom forward edge of the lower front surface at least as far as said most forward portion of said front surface of the main shock absorber member and having an air chamber with air vent holes communicating with the air chamber to vent air out of said main shock absorber member, said vent holes being dimensioned so as to permit air to escape gradually during compression of said air chamber; and at least one of said air vent holes having a bushing disposed therein to maintain an open channel during compression of said air chamber.

15. A shock absorbing wall comprising:

a main shock absorber member formed of an elastic material, said main shock absorber member having a supporting portion at an upper portion thereof and a bottom forward edge;

a sub-shock absorber member mounted on said supporting portion of said main shock absorber member;

said main shock absorber member having a front surface with a center area, a lower front surface concavely extending from said bottom forward edge of said main shock absorber member to said center area of said front surface, and a most forward portion at said center area;

the sub-shock absorber member projecting forward of the bottom forward edge of the lower front surface at least as far as said most forward portion of said front surface of the main shock absorber member and having an air chamber with air vent holes communicating with the air chamber to vent air out of said main shock absorber member, said vent holes being dimensioned so as to permit air to escape gradually during compression of said air chamber;

said main shock absorber member and said sub-shock absorber member being connected with threaded fastening means;

said supporting portion having a concavity and said sub-shock absorber member having a projecting portion fitting into the concavity of said main shock absorber member; and at least one of said air vent holes having a bushing disposed therein to maintain an open channel during compression of said air chamber.

16. A shock absorbing wall comprising:

a main shock absorber member formed of an elastic material, said main shock absorber member having a supporting portion at an upper portion thereof and a bottom forward edge;

a sub-shock absorber member mounted on said supporting portion of said main shock absorber member;

said main shock absorber member having a front surface, the front surface having a center area, a lower front surface, and a most forward portion at said center area, said lower front surface extending from said bottom forward edge of said main shock absorber member to said center area of said front surface; and the sub-shock absorber member projecting forward of the bottom forward edge of the main shock absorber member at least as far as said most forward portion of said front surface of the main shock absorber member and having an air chamber with air vent holes communicating with the air chamber to vent air out of said main shock absorber member, said vent holes being dimensioned so as to permit air to escape gradually during a crash impact.

17. The shock absorbing wall according to claim 16 wherein said sub-shock absorber member projects forward of said most forward portion of said front surface of the main shock absorbing member.

18. A shock absorbing wall comprising:

a main shock absorber member formed of an elastic material, said shock absorber member having a supporting portion at an upper portion thereof and a bottom forward edge;

a sub-shock absorber member mounted on said supporting portion of said main shock absorber member;

said main shock absorber member having a front surface, the front surface having a center area, a lower front surface, and a forward projecting portion at said center area projecting forward of said bottom forward edge, said lower front surface extending from said bottom forward edge of said main shock absorber member to said center area of said front surface; and the sub-shock absorber member projecting forward of the bottom forward edge of the main shock absorber member at least as far as said forward projecting portion of said front surface of the main shock absorber member and having an air chamber with air vent holes communicating with the air chamber to vent air out of said main shock absorber member, said vent holes being dimensioned so as to permit air to escape gradually during a crash impact.

19. The shock absorbing wall as defined in claim 18 wherein the supporting portion extends to form an upper front surface of said main shock absorber member enclosing a forward surface of said sub-shock absorption member.

20. The shock absorbing wall as defined in claim 19 wherein said sub-shock absorber member has at least two air chambers, including said air chamber, within the sub-shock absorber member, and a partition separating said at least two air chambers and having a plurality of air vent holes provided in said partition interconnecting the at least two air chambers.

21. The shock absorbing wall as defined in claim 20 further comprising a cylindrical bushing fitted into at least one vent hole of said air vent holes and said plurality of air vent holes, said at least one air vent hole being disposed near the front surface of the sub-shock absorber member, so as to maintain said at least one vent hole in an open state during said crash impact.

22. The shock absorbing wall as defined in claim 21 wherein a thickness of the partition inside said sub-shock absorption member increases towards a back side of the sub-shock absorber member.

23. The shock absorbing wall according to claim 18 wherein said sub-shock absorber member projects forward of said forward projecting portion of said front surface of the main shock absorbing member.

24. The shock absorbing wall according to claim 18 wherein said forward projecting portion of said front surface of the main shock absorber member is a most forward projecting portion of said main shock absorbing member.

25. A shock absorbing wall comprising:

a shock absorber member formed of an elastic material, said shock absorber member having an upper portion and a bottom forward edge;

said shock absorber member having a front surface, the front surface having a center area, a lower front surface, and a forward projecting portion at said center area projecting forward of said bottom forward edge, said lower front surface extending from said bottom forward edge of said shock absorber member to said center area of said front surface; and said upper portion of the shock absorber member projecting forward of the bottom forward edge of the shock absorber member at least as far as said forward projecting portion at said center area of said front surface of the shock absorber member and having an air chamber with air vent holes communicating with the air chamber to vent air out of said shock absorber member, said vent holes being dimensioned so as to permit air to escape gradually during a crash impact.

26. The shock absorbing wall according to claim 25 wherein said upper portion of said shock absorber member projects forward of said forward projecting portion at said center area of said front surface of the shock absorber member.

27. The shock absorbing wall according to claim 25 wherein:

said shock absorbing member includes a main shock absorber member and a sub-shock absorbing member;

said sub-shock absorbing member includes said upper portion of said shock absorber member; and said main shock absorbing member has a supporting portion for supporting said sub-shock absorbing member.

* * * * *